United States Patent [19]

Yahiro et al.

[11] 4,047,580

[45] Sept. 13, 1977

[54] HIGH-VELOCITY JET DIGGING METHOD

[75] Inventors: Teruo Yahiro; Hiroshi Yoshida, both of Tokyo, Japan

[73] Assignees: Chemical Grout Company, Ltd.; Kajima Corporation, both of Tokyo, Japan

[21] Appl. No.: 666,280

[22] Filed: Mar. 12, 1976

Related U.S. Application Data

[63] Continuation of Ser. No. 523,647, Nov. 13, 1974, abandoned.

[30] Foreign Application Priority Data

Sept. 30, 1974 Japan ..... 49-111600

[51] Int. Cl.[2] ..... E21B 7/18

[52] U.S. Cl. ..... 175/67; 37/78; 175/422; 299/17

[58] Field of Search ..... 175/67, 14, 422; 299/17, 16; 37/78, 195; 239/290, 105, 265.23

[56] References Cited

U.S. PATENT DOCUMENTS 3,572,839 8/1968 Okabe ..... 299/17

FOREIGN PATENT DOCUMENTS 2,035,934 2/1972 Germany ..... 299/17

*Primary Examiner*—Stephen J. Novosad

*Attorney, Agent, or Firm*—Beveridge, DeGrandi, Kline & Lunsford

[57] ABSTRACT

The method of digging by piercing soil and rock with a jet of liquid discharged at high velocity from a nozzle together with high-velocity air jets discharged from another nozzle arranged concentrically around the liquid nozzle, characterized by the velocity of the air jets being at least half the velocity of sound.

4 Claims, 7 Drawing Figures

HIGH-VELOCITY JET DIGGING METHOD

This is a continuation, of application Ser. No. 523,647 filed Nov. 13, 1974 Now abandoned.

The present invention relates to an improved method of digging by piercing and crushing the earth's soil and rock with a high-velocity liquid jet. It is known to construct sand seams and solidified bodies such as watertight walls by digging, crushing, piercing and injecting with high-velocity jets of liquid such as water discharged from nozzles. High-velocity liquid jets are utilized in various construction techniques known as jet grouting, sand draining, jet piling, etc. These methods are effectively used because they are high in digging efficiency, provide high energy-density rates and require but a relatively small and simple device for producing high-velocity liquid jet. It is usually in the strata with subterranean water or at the sea floor that high-velocity liquid jets are used for piercing and crushing. The water encountered in such locations rapidly slows down the velocity of jetted liquid to reduce the working efficiency of the jet. Specifically, the in-water distance that the liquid jet can traverse ranges from about 1/10 to 1/15 of the in-air distance that the jet can traverse. This accounts for the inability of a high-velocity liquid jet to perform well when the jet of liquid is directed into an area of water.

In order to increase the in-water distance that the high-velocity liquid jet traverses, it has been proposed in the prior art that an air jet be discharged from a ring-shaped nozzle surrounding the liquid jet nozzle, so that the air jet will envelop the high-velocity liquid jet. Devices implementing this proposition have been successful in increasing the distance traversed by high-velocity liquid jets in water and, moreover, the air jet was noted to facilitate removal of loosened or crushed muck because of its air lifting effect. An example of such a practice in connection with jet grouting is the subject of U.S. Pat. No. 3,802,203 which is incorporated herein by reference.

Even with such a high-velocity liquid jet enveloped by air jet, a drawback has been noted in that there are fluctuations in the distance traversed by the liquid jet, termed the liquid jet distance in this specification, thus introducing discontinuous portions in watertight wall construction, or producing an anisotropic or non-homogeneous deposition of the cementing agent in solidifying work.

The object of this invention is to provide a method of enabling the high-velocity liquid jet enveloped by an air jet to traverse a longer and more uniform distance.

According to this invention, a gaseous jet produced by the ring-shape nozzle to envelope the liquid jet is discharged at a velocity which is at least half the speed of sound in the respective gas. The gas will normally be air due to its availability; however, other gaseous mediums may be used within the spirit of this invention.

In order to render the present invention easier to understand, the principles of digging by high-velocity liquid jet will be described.

DESCRIPTION OF A PREFERRED EMBODIMENT

It is known that, in drilling into or crushing soil and rock with a high-velocity liquid jet, the depth of the drilled hole or hole dug by crushing is determined by this equation:

$$S = K\,d\,(V_c/C)^{3/2}$$

where S is the depth of the hole, K is a constant taking a definite value for each type of material to be pierced, $d$ is the nozzle orifice diameter, C is the velocity of elastic wave (longitudinal) of the material to be pierced, and $V_c$ is the velocity of the liquid jet.

From the above equation, it will be seen that, the larger the nozzle orifice diameter $d$ or the greater the velocity $V_c$ the deeper is the hole, that is, the larger is the value of S. As is well-known, velocity $V_c$ is proportional to pressure.

Figure 1:
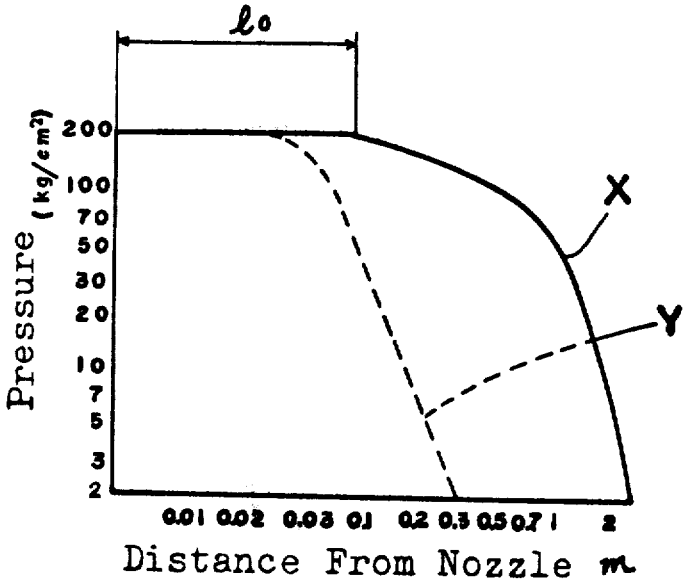
FIG. 1 is a graph which illustrates the pressures along a liquid jet as a function of the distance from the jet-emittingnozzle.

The relationship between the pressure of the liquid (the jet pressure) and its distance from the nozzle outlet (the jet distance) is graphically shown in FIG. 1, in which the liquid pressure in kg/cm² is the ordinate and the distance from the nozzle in meters is the abscissa. The solid-line curve X refers to a liquid jet in air and the broken line curve Y to a liquid jet in water. As will be noted in this graph, the jet pressure in water decreases more rapidly than in air, so that the liquid jet in water is inherently unable to dig deeply.

Figure 2:
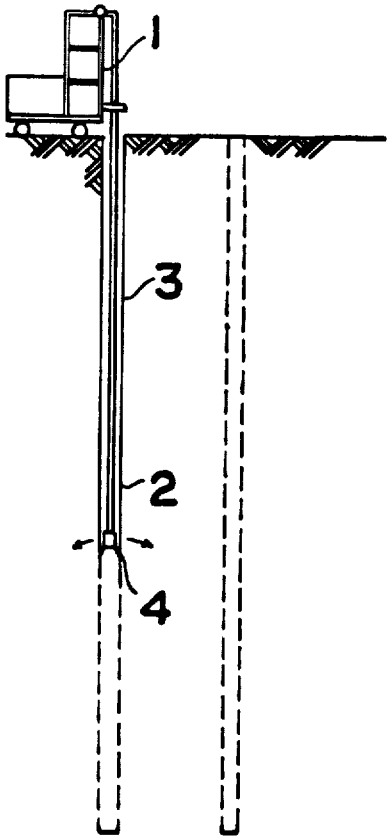
FIG. 2 shows apparatus for jet grouting.
Figure 3:
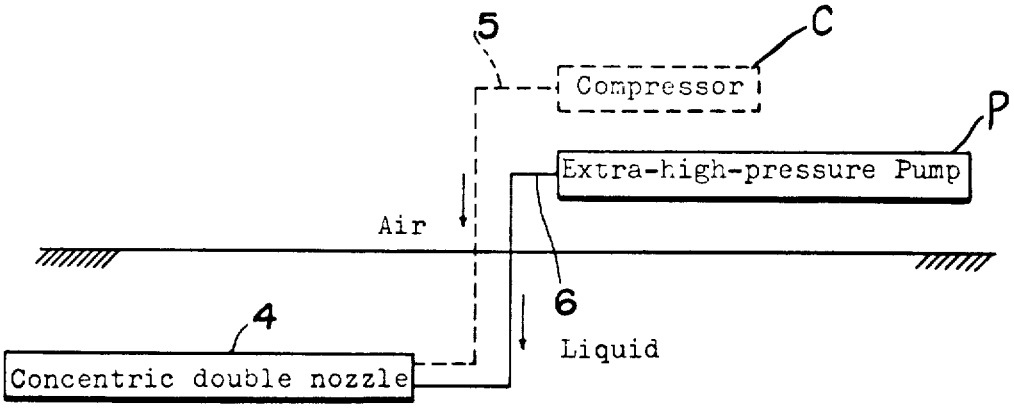
FIG. 3 is a block diagram of components of components of a system used in connection with the apparatus of FIG. 2.
Figure 4:
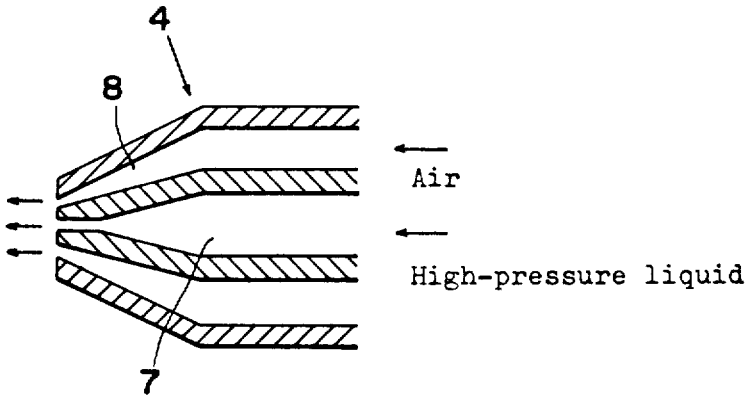
FIG. 4 shows a cross section of a nozzle used in the apparatus of FIGS. 2 and 3.

To overcome this limitation, the technique of enveloping the liquid jet by an air jet, as described above, was developed. An example of the device for implementing this technique, shown in FIGS. 2, 3 and 4, is known and is not in itself novel. FIG. 2 is a diagram schematically illustrating the jet grouting process and indicates the digging machine 1 and a pipe rod 3 which extends from the digging machine into the hole 2. A nozzle 4 is located at the distal end of the pipe rod 3. FIG. 3 is a block diagram showing a compressor C and a pump P, both of which are included in the digging machine 1. An air pipe 5 extending from the compressor C and a liquid pipe 6 extending from the pump P are routed along the pipe rod 3 and connected to the nozzle 4. FIG. 4 shows nozzle 4 in longitudinal cross section, wherein at the center of the nozzle is a liquid-jet passage 7 to which liquid pipe 6 conveys the liquid. Note in FIG. 4 that the center passage 7 is surrounded by air-jet passage 8, which is annular in transverse cross section and to which air pipe 5 conveys the enveloping air.

The air supplied by compressor C is released from the air-jet passage 8 while the liquid is discharged from liquid-jet passage 7, so that, when both air and liquid are being discharged, the stream of jet liquid becomes enveloped by the annular stream of air.

When the nozzle is immersed in water, the stream of air from passage 8 envelopes the liquid jet from passage 7, isolating the water jet from the surrounding water so that it advances as if the nozzle were being used in the atmosphere of air. This manner of discharge from the nozzle enables the high-velocity liquid jet to traverse a greater distance than is otherwise possible.

Figure 5:
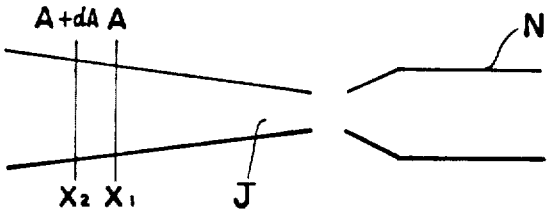
FIG. 5 is a diagrammatic drawing of a nozzle and a jet emitted thereby.

The present inventor, in conducting extensive experimental research work, discovered that there is a relationship between the distance traversed by a high-velocity liquid jet and the velocity of enveloping air jet produced by the air-jet passage 8 of the nozzle. The grounds of this relationship will be explained in reference to FIG. 5.

The jet stream J emerging from nozzle N increases its transverse cross section area as the liquid advances from the nozzle tip. A position $X_1$ of the stream is located at a given distance from the nozzle tip and its cross section area is represented by A and the corresponding stream velocity by U. At another position $X_2$, separated by an infinitesimally small distance from position $X_1$, dA represent the increment of cross section area and dU the reduction in velocity, both occurring through that small separating distance between the two positions under consideration. It is known that, for such a jet, the following equation is valid:

$$dU/U = (dA/A)/(1 - M^2)$$

where M stands for the Mach number.

Theoretically, the denominator in the right-hand member of the above equation becomes zero if the velocity of air being discharged is equal to the Mach number 1; and, since dU/U is finite, dA too must become zero. Stated differently, if M = 1, then dA = 0, meaning that there is no increase in the cross section area of the jet stream. Applying this relationship to the air jet produced by ejecting air from the concentric air jet passage 8 of nozzle 4 in FIG. 4, it will be seen that, if the air is ejected at a velocity equal to its Mach number, the resultant air jet envelops the liquid jet at the center and shoots forward with the center jet. Consequently, the liquid jet too does not increase its cross section and is thus enabled to traverse a greater distance.

Figure 6:
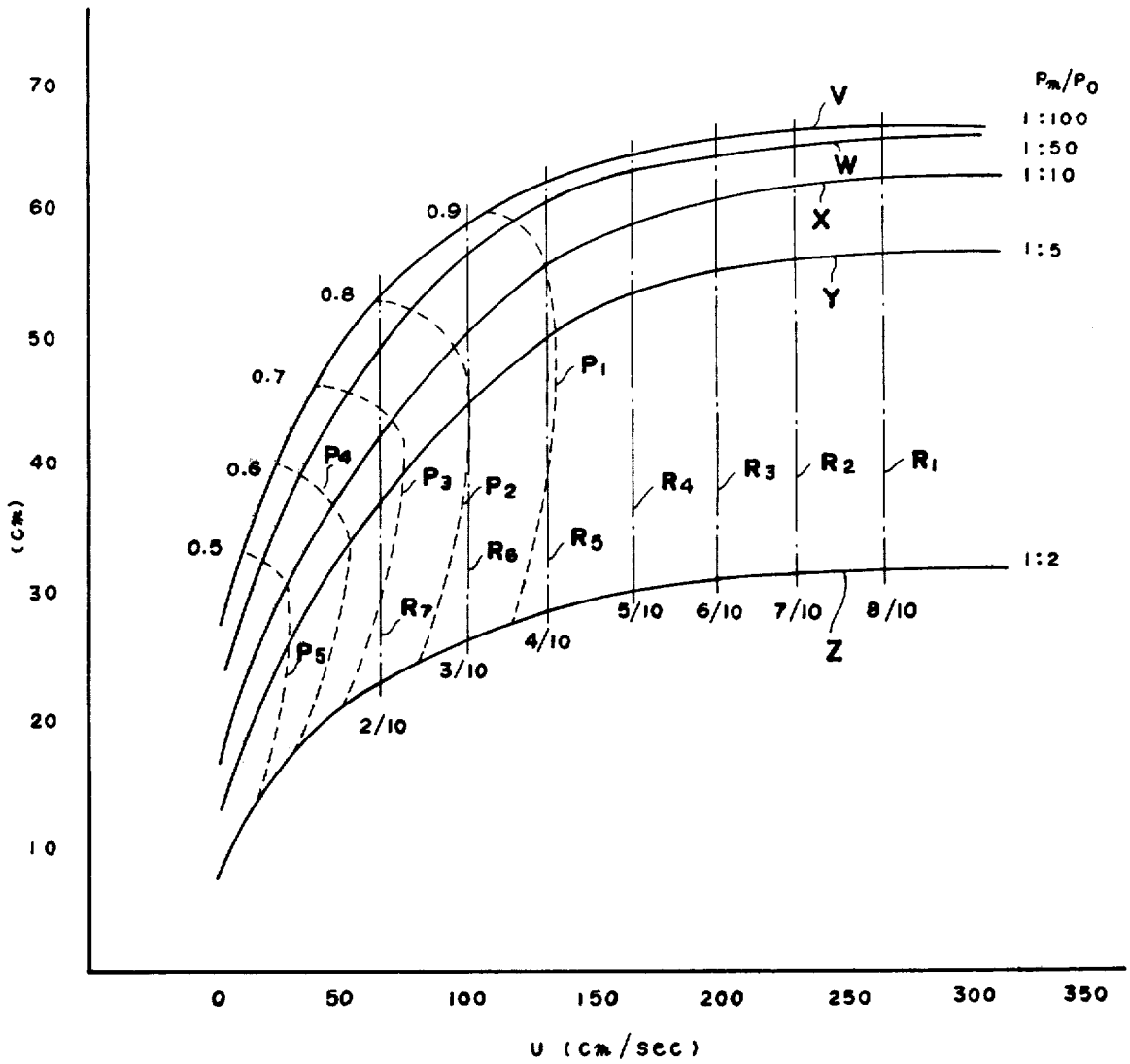
FIG. 6 is a graph of experimental tests in which the velocity of the air jet was varied.

FIG. 6 is a graph showing the results of experimental tests in which the velocity of the air jet was varied. Air velocity in cm/second is plotted on the horizontal axis; the distance in centimeters from the nozzle is plotted on vertical axis; and the pressure reduction ratio $P_m/P_o$ is taken as the parameter, $P_m$ representing the pressure in axial direction and $p_o$ representing the pressure at the nozzle outlet, these pressures occurring through and along the liquid jet. Curves V, W, X, Y and Z are for $P_m/P_o$ ratios of 1/100, 1/50, 1/10, 1/5 and 1½2, respectively, in that order. The vertical broken lines $R_1$ through $R_7$, inclusive, represent the proportion of air velocity U in the maximum air velocity $U_m$ ( of which mention will be made later), and are drawn through the points where the proportion is 8/10 for $R_1$, 7/10 for $R_2$, 6/10 for $R_3$, 5/10 for $R_4$, 4/10 for $R_5$, 3/10 for $R_6$, and 2/10 for $R_7$ line. The sonic speed of air changes with temperature but is normally between 330 and 345 m/sec. In the present experiment, $U_{max}$ = 329 m/sec was used so that one-half the sonic speed is 165 m/sec. The nearly vertical broken lines $P_1$ through $P_5$, inclusive, represent the ratio of distance X traversed to the maximum distance $X_{max}$, the ratio being 0.9 for $P_1$, 0.8 for $P_2$, 0.7 for $P_3$, 0.6 for $P_4$ and 0.5 for $p_5$.

It will be seen in FIG. 6 that, the higher the velocity of the air jet, the greater the distance traversed by this jet. Curves V through Z, inclusive, flatten out or level off in the region of higher air jet velocity U. In order to secure a traversed distance which is, say, 90% of the maximum distance $X_{max}$, the air jet must take its velocity value to the right of line $P_1$. This means that air velocity must be at least half the sonic speed.

Figure 7:
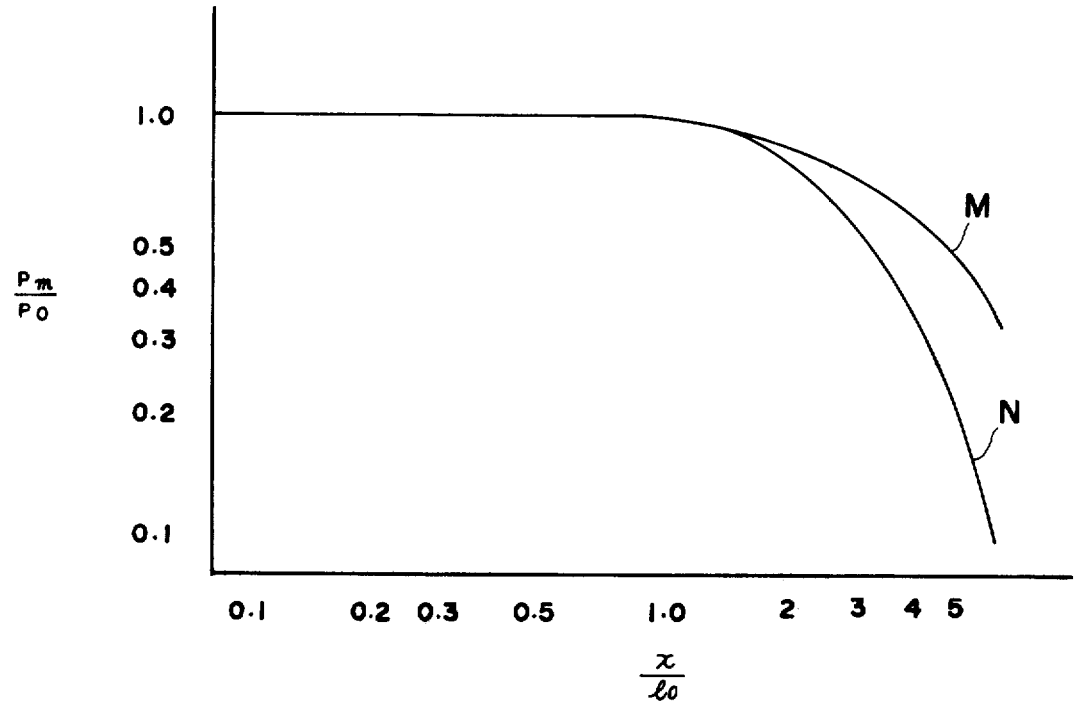
FIG. 7 is a graph showing characteristics of the jet liquid in the practice of the invention, both when ejecting into air and when ejecting into water.

FIG. 7 refers to the ejection of jet liquid and, in the form of curves plotted from the data obtained, compares graphically ejection in air against ejection in water according to the present invention. The horizontal axis is scaled by the ratio of the initial region $1_o$ (to be explained later) to the distance X tranversed from the nozzle outlet; and the vertical axis is scaled by the pressure reduction ratio, $P_m/P_o$, occurring through and along the liquid jet. The initial region $1_o$ refers to the length of the level portion of the curve shown in FIG. 1, that is, the distance in which pressure $P_m$ remains constant. Curve M represents ejection into air, and curve N the ejection into water according to this invention. As will be noted in this figure, the initial region $1_o$ according to this invention is substantially similar in property to that for ejection into air. For the distance beyond the end of $1_o$, the jet in water according to this invention is inferior to the jet formed in air but will be noted to be an appreciable improvement over the curve Y of FIG. 1.

It will be seen from the foregoing description that, according to the present invention, the effectiveness of liquid jet crushing or the depth of liquid jet drilling is increased significantly and, as will be noted in FIGS. 6 and 7, the distance traversed by the liquid jet can be held constant. By these significant advantages, the method of crushing or piercing with a high-velocity liquid jet according to this invention is highly useful and effective in various types of construction work.

What is claimed is:

1. A method of digging in the earth comprising the steps of moving a nozzle along a subterranean longitudinal path while directing a high velocity jet of liquid from the nozzle in a direction which is transverse to said path, surrounding the jet of liquid with a gaseous jet directed substantially parallel to the jet of liquid, reducing increases in the cross section of the jet of liquid and increasing and making more uniform its effective length by maintaining the velocity of the jet of gas at least about one-half the velocity of sound in the gas.

2. The method of claim 1 wherein the velocity of the gaseous jet is at least about 165 meters per second.

3. The method of claim 1 wherein both the jet of liquid and the gaseous jet are directed into and pass through a body of water before striking the earth which is being dug.

4. The method of claim 3 wherein the velocity of the gaseous jet is at least about 165 meters per second.

* * * * *